US006447316B1

(12) United States Patent
Jon et al.

(10) Patent No.: US 6,447,316 B1
(45) **Date of Patent: *Sep. 10, 2002**

(54) METHOD TO ELIMINATE OR REDUCE ESD ON CONNECTORS

(75) Inventors: Min-Chung Jon, Princeton Junction; Don L. Lin, Neshanic Station, both of NJ (US); Kenneth William Vriesema, Jamison, PA (US)

(73) Assignee: Avaya Technology Corp., Basking Ridge, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/321,942

(22) Filed: May 28, 1999

(51) Int. Cl.[7] ..... H01R 13/53
(52) U.S. Cl. ..... 439/181
(58) Field of Search ..... 439/181, 108, 439/620

(56) References Cited

U.S. PATENT DOCUMENTS

| | | | | | |
|---|---|---|---|---|---|
| 4,568,133 | A | * | 2/1986 | Amano et al. | 439/108 |
| 4,824,377 | A | * | 4/1989 | Burro | 439/186 |
| 5,256,074 | A | * | 10/1993 | Tan et al. | 439/108 |
| 5,474,472 | A | * | 12/1995 | Niwa et al. | 439/608 |
| 6,074,225 | A | * | 6/2000 | Wu et al. | 439/101 |

* cited by examiner

*Primary Examiner*—Brian Sircus
*Assistant Examiner*—Brian S. Webb
(74) *Attorney, Agent, or Firm*—Woodbridge & Associates, P.C.; Richard C. Woodbridge, Esq.

(57) ABSTRACT

This invention relates to a method of manufacturing electrical connectors with an improved grounding configuration so that the potentially harmful effects of ESD currents are minimized. In the preferred embodiment of the present invention, D-sub connectors are modified to include a central grounding strip between rows of pin openings in a manner that is highly effective in grounding ESD events and, in particular, more readily qualify such a modified connector to meet strict ESD testing requirements.

16 Claims, 2 Drawing Sheets

METHOD TO ELIMINATE OR REDUCE ESD ON CONNECTORS

BACKGROUND OF THE INVENTION

1. Field of the Invention

This invention relates to placing an additional grounding strip on an electrical connector so that at the time a connection is made, currents resulting from electrostatic discharge events (ESD) will be properly grounded.

2. Description of Related Art

The potential harmful effects to electrical components resulting from ESD are well known. To minimize these effects, buyers of electrical connectors frequently require that these connectors have grounding protection and that this protection meet certain tests. By way of example, Bellcore has specific tests that D-Sub connectors must pass in order to be qualified for use (i.e., TR-NWT-001089 Sect. 2.3, ESD Test Methods). Such D-SUB connectors typically have a ground plane over the pin openings (e.g., ITT CANNON 9334 DBM53513-1792 25-pins female D-SUB) to eliminate or reduce ESD problems during ESD qualification of the connectors. The ground plane on the D-SUB connector is intended for attracting the ESD and directing the harmful discharge current to ground so that there will be no ESD exposure to components on boards on which the connector is mounted.

As this grounding plane is frequently insufficient to meet the testing requirements, additional grounding methods have been employed. One such method is to use a grounded metal foil to attract the ESD events. As depicted in FIG. 1 the ground plane for the ITT CANNON connector is made of a metal foil with openings (cut-out holes) to match those on the connector. When placing the metal foil over the pin openings of the connector, the openings on the metal foil must be aligned perfectly with those on the connector to insure that the connector will mate properly (otherwise, there will be shorts between the pins and the ground). Because of this reliability concern, other costly techniques have also been investigated to improve reliability when modifying the D-SUB connectors to meet the Bellcore ESD requirements.

One such technique employs using a metal coating to attract ESD events. As depicted in FIG. 2 this technique is to paint a thin metal coating over the whole surface of the pin opening of the connector (e.g., CINCH connector). The problem with the painting technique is that the integrity of the thin coating, placed over the pin openings of the connector, can not be visually inspected and verified. Thus, it is extremely expensive to make D-SUB connectors that can meet the Bellcore ESD requirements. Further, many vendors do not even attempt to meet strict ESD testing requirements, such as those imposed by Bellcore, because of the reliability concerns regarding the use of a ground plane over the pin openings.

SUMMARY OF THE INVENTION

The present invention employs a new method for eliminating or reducing ESD on connectors. This method uses a much simpler ground plane (a strip line) that can be placed between the rows of the pin openings of the connector to eliminate ESD while maintaining high reliability.

These and other features of the invention will be more fully understood by reference to the following drawings.

DETAILED DESCRIPTION OF THE INVENTION

During the course of this description, like numbers will be used to identify like elements according to different figures which illustrate the invention.

The goal of the present invention is to provide an effective, inexpensive method of manufacturing electrical connectors with an improved grounding configuration so that the potentially harmful effects of ESD currents are minimized. In the preferred embodiment of the present invention, D-sub connectors are modified to include a central grounding strip between rows of pin openings in a manner that is highly effective in grounding ESD events and, in particular, more readily qualify such a modified connector to meet strict ESD testing requirements such as those imposed by Bellcore (e.g., TR-NWR-001089).

Figure 2:
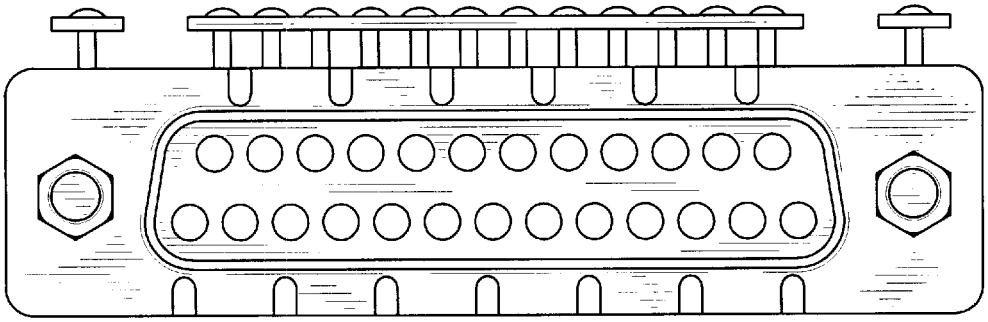
FIG. 2 (PRIOR ART)
FIG. 2 is a perspective view of a conventional connector whose surface is painted with a thin metal coating.
Figure 1:
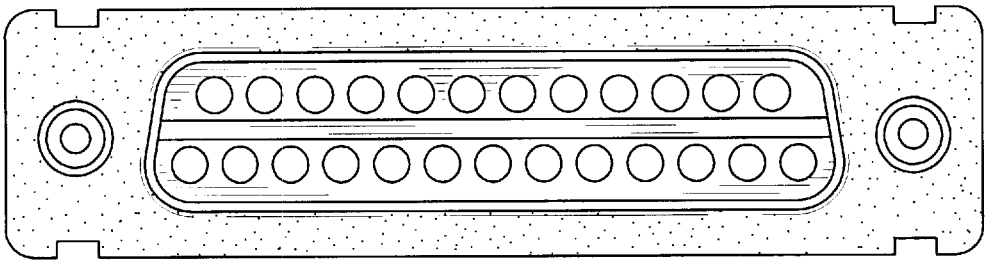
FIG. 1 (PRIOR ART)
FIG. 1 is a perspective view of a conventional connector having a metal foil ground plane.
Figure 3:
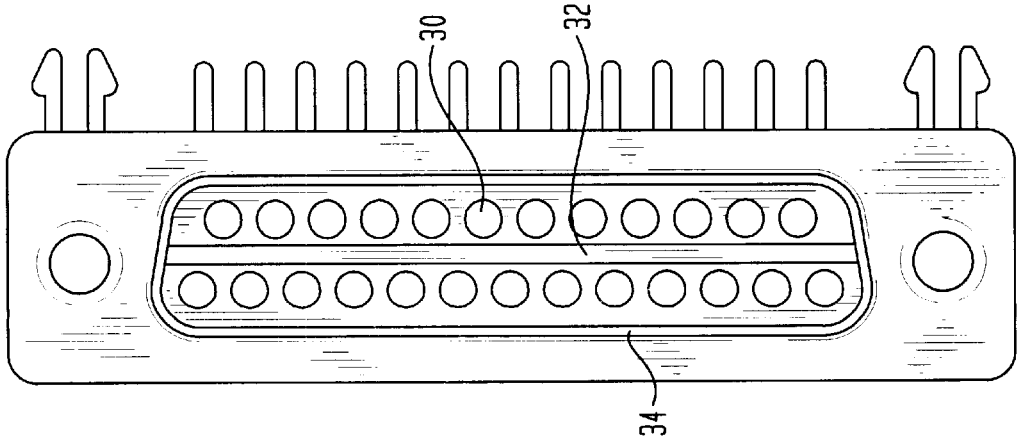
FIG. 3 is a perspective view of the preferred embodiment of the invention having a central grounding strip between rows pin openings.

Unlike the above referenced prior art depicted in FIGS. 1 and 2 which effectively place a whole ground plane over the pin openings of the connector, the preferred embodiment of the present invention uses a single strip line ground between the rows of the pin openings. This line is a metal strip, approximately 0.06 cm wide, which can be wider or narrower dependent on the spacing between the rows of the pin openings on the connector. Thus, as depicted in FIG. 3, only one strip metal line is required for the two rows of openings in a D-SUB connector. Each row of the pin openings is now bordered by a ground plane consisting of the grounded metal casing and the strip line.

Figure 4:
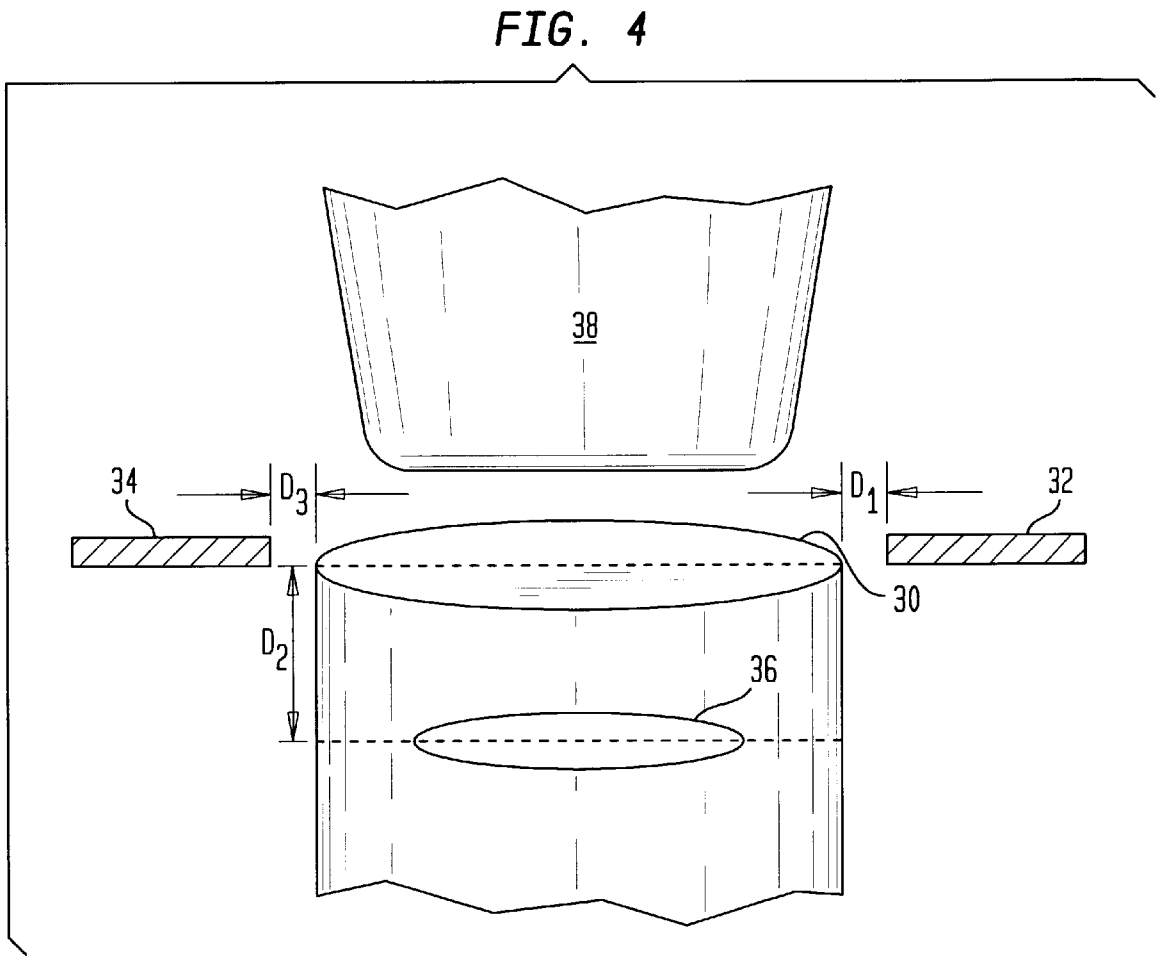
FIG. 4 is a horizontal, cross-sectional view of dimensional relationships of a pin opening of the preferred embodiment.

When a charged object approaches the pin opening of the connector, the charged object will discharge to either the grounded metal casing or the grounded strip line. The charged object will not discharge to the metal socket inside the pin opening because the metal socket is placed below (in the recess) the surface of pin opening. For example, the ITT CANNON referenced above has a recess distance of 0.018 inches (±0.001 inches). In the preferred embodiment, the distance between the approaching charged object and the grounded casing or the strip line must be shorter than that between the approaching charged object and the metal socket inside the pin opening. By way of example, FIG. 4 depicts the probe tip of an ESD test device 38 being inserted into a pin opening 30. Such a test device would be any ESD gun meeting IEC 61000-4-2 standards. The taper of the end of the test probe 38 frequently causes failures in the qualification process of prior art connectors. That is, if the probe is inserted in the opening in a manner that maximizes the distance between the device 38 and the grounded casing 34, an ESD would frequently cause a current discharge to the metal socket 36. In the preferred embodiment of the present invention, the addition of grounding strip 32 at a distance $D_1$ from the pin opening 30 together with the grounded casing 34 at a distance $D_3$ from the pin opening, precludes an ESD discharge of the test device 38 to the metal socket 36. That is, in the preferred embodiment in which $D_3$ approximately equals $D_1$, irrespective of the orientation of the probe, the distance between it and the nearer of grounds 32 or 34 will be less than the distance $D_2$ to the metal socket 36.

The preferred embodiment of the present invention wherein D-SUB connectors have been manufactured with such a metal strip has been experimentally verified to be effective in eliminating any likely ESD exposure to components on boards where the connector is mounted. The grounded strip line, used on the D-SUB connector to eliminate ESD and to improve the connector reliability, can be cost-effectively applied to any kind of connectors. The strip line can also be manufactured as part of the connector casing (the metal housing), which should greatly reduce the cost of making the connectors that can meet the Bellcore ESD requirements. Since reliability of the resulting connector is no longer a concern, the concept of making the connectors to eliminate or reduce ESD problems will be much more readily accepted by the connector manufacturing industry thereby reducing costs of manufacture. Once the cost and reliability are no longer the concerns, the connector vendors will be more likely to make their connectors for ESD protective applications, which should result in less ESD damage to the circuit boards (and the systems).

While the invention has been described with reference to the preferred embodiment thereof, it will be appreciated by those of ordinary skill in the art that various modifications can be made to the structure and function of the individual parts of the system without departing from the spirit and scope of the invention as a whole.

We claim:

1. An electrical connector with a mounting surface capable of receiving a pinned electrical connector comprising:

an electrically conductive casing located along the perimeter of the mounting surface of said connector;

two or more pin holes each having a pin opening located on the mounting surface and each containing a metal socket located beneath said mounting surface, wherein said pin openings are arranged in n rows (n being an integer greater than 1); and, n−1 metal grounding strips located between said n rows of pin openings, wherein each strip is substantially planar, is located in proximity of said surface and has an electrical connection to said casing, providing a discharge path from grounding strip to casing;

whereby for each pin opening, the minimum of the distance between said pin opening and said casing; and, the distance between said pin opening and said grounding strip is less than the distance between said mounting surface and said metal socket, thereby allowing an approaching charged object to discharge to ground into either said casing or said grounding strip rather than said metal socket;

wherein said grounding strips are flat, having sharp edges, and are planar to said mounting surface and said sharp edges attract and draw away static electricity present during insertion of said pinned electrical connector.

2. The electrical connector of claim 1 wherein the approaching charged object enters one of said pin openings at a variable angle of incidence and wherein said minimum of the distance between said pin opening and said casing and the distance between said pin opening and said grounding strip causes said discharge to ground irrespective of the angle of incidence.

3. The electrical connector of claim 2 wherein n=2 and the pin openings are arranged in two parallel rows.

4. An electrical connector with a mounting surface capable of receiving a plurality of electrical connector pins comprising:

an electrically conductive casing located along the perimeter of the mounting surface of said connector;

two or more pin receiving means each having pin openings located on the mounting surface, where each receiving means contains a metal socket located beneath said mounting surface, wherein said pin openings are arranged in n rows (n being an integer greater than 1); and, n−1 metal grounding strips that are located beneath said surface, so that for each pin opening, the minimum of the distance between said pin opening and said casing; and, the distance between said pin opening and said grounding strip is less than the distance between said mounting surface and said metal socket, thereby allowing an approaching charged object to discharge into either said casing or said grounding strip rather than said metal socket;

wherein said grounding strips are flat, having sharp edges, and are planar to said mounting surface and said sharp edges attract and draw away static electricity present during insertion of said pinned electrical connector.

5. All electrical connector comprising:

all electrically conductive casing located along the perimeter of the mounting surface of said connector;

two or more pin holes each containing a pin opening located on the mounting surface and each having a metal socket located beneath said mounting surface, wherein said pin openings are arranged in n rows (n being an integer greater than 1); and, n−1 metal grounding strips located between said n rows of pin openings, wherein each strip is substantially planar, is located in proximity of said surface and has an electrical connection to said casing, providing a discharge path from grounding strip to casing;

whereby for each pin opening, the minimum of the distance between said pin opening and said casing; and, the distance between said pin opening and said grounding strip is less than the distance between said mounting surface and said metal socket, thereby allowing an approaching charged object to discharge to ground into either said casing or said grounding strip rather than said metal socket;

wherein said grounding strips are flat, having sharp edges, and are planar to said mounting surface and said sharp edges attract and draw away static electricity present during insertion of said pinned electrical connector.

6. The electrical connector of claim 5 wherein for each pin opening, the distance between said pin opening and said casing is substantially equal to the distance between said pin opening and said grounding strip.

7. The electrical connector of claim 6 wherein said metal strip is approximately 0.06 cm wide.

8. The electrical connector of claim 7 wherein said electrical connection comprises two or more points of electrical contact between said strip and said casing.

9. The electrical connector of claim 8 wherein said connector is a D-SUB-type connector.

10. The electrical connector of claim 5 wherein the approaching charged object enters one of said pin openings at a variable angle of incidence and wherein said minimum of the distance between said pin opening and said casing and the distance between said pin opening and said grounding strip causes said discharge to ground irrespective of the angle of incidence.

11. The electrical connector of claim 5 wherein said connector is a D-SUB type of connector and said metal grounding strips are located on the face of said mounting surface.

12. The electrical connector of claim 5 wherein said metal strip is approximately 0.06 cm wide.

13. An electrical connector with a mounting surface capable of receiving a plurality of electrical connector pins comprising:

an electrically conductive casing located along the perimeter of the mounting surface of said connector;

two or more pin receiving means each having pin openings located on the mounting surface, where each receiving means contains a metal socket located beneath said mounting surface, wherein said pin openings are arranged in n rows (n being an integer greater than 1); and, n−1 metal grounding strips tat are located in proximity of said surface, so that for each pin opening, the minimum of the distance between said pin opening and said casing; and, the distance between said pin opening and said grounding strip is less than the distance between said mounting surface and said metal socket, thereby allowing an approaching charged object to discharge into either said casing or said grounding strip rather than said metal socket;

wherein said grounding strips are flat, having sharp edges, and are planar to said mounting surface and said sharp edges attract and draw away static electricity present during insertion of said pinned electrical connector.

14. The electrical connector of claim 13 wherein the approaching charged object enters one of said pin openings at a variable angle of incidence and wherein said minimum of the distance between said pin opening and said casing and the distance between said pin opening and said grounding strip causes said discharge to ground irrespective of the angle of incidence.

15. The electrical connector of claim 13 wherein said connector is a D-SUB-type connector and said grounding strip is located on the top face of said mounting surface.

16. The electrical connector of claim 13 wherein said metal strip is approximately 0.06 cm wide.

* * * * *